US007238088B1

(12) United States Patent
Genis et al.

(10) Patent No.: US 7,238,088 B1
(45) Date of Patent: Jul. 3, 2007

(54) ENHANCED DIAMOND POLISHING

(75) Inventors: Alfred R. Genis, East Douglas, MA (US); William W. Dromeshauser, Norwell, MA (US); Robert C. Linares, Sherborn, MA (US)

(73) Assignee: Apollo Diamond, Inc., Framingham, MA (US)

( * ) Notice: Subject to any disclaimer, the term of this patent is extended or adjusted under 35 U.S.C. 154(b) by 0 days.

(21) Appl. No.: 11/326,242

(22) Filed: Jan. 5, 2006

(51) Int. Cl.
*B24B 1/00* (2006.01)

(52) U.S. Cl. ..... 451/57; 451/41

(58) Field of Classification Search ..... 451/41, 451/57, 59, 36, 37, 54; 134/1.2, 1.3, 3, 902; 438/690, 691, 692, 693; 15/21.1
See application file for complete search history.

(56) References Cited

U.S. PATENT DOCUMENTS 5,389,194 A * 2/1995 Rostoker et al. ..... 134/1.3
5,746,931 A * 5/1998 Graebner et al. ..... 216/88
6,276,997 B1 * 8/2001 Li ..... 451/41
6,319,095 B1 * 11/2001 Merchant et al. ..... 451/36
2006/0102854 A1 * 5/2006 Neogi et al. ..... 250/492.1

FOREIGN PATENT DOCUMENTS

WO WO-06047611 A2 5/2006

* cited by examiner

*Primary Examiner*—Dung Van Nguyen
(74) *Attorney, Agent, or Firm*—Schwegman, Lundberg, Woessner & Kluth, P.A.

(57) ABSTRACT

A grown single crystal diamond is polished using a non contact polishing technique, which leaves a residue on the diamond surface. In one embodiment, a wet chemical etch is performed to remove the residue, leaving a highly polished single crystal diamond surface. In a further embodiment, a colloidal silica solution is used in combination with rotating polishing pads to remove the residue. Both residue removing techniques may be used in further embodiments.

32 Claims, 2 Drawing Sheets

ENHANCED DIAMOND POLISHING

BACKGROUND

Single crystal diamond manufactured using chemical vapor deposition (assisted by plasma, hot filament, flame, etc) is harder than any other semiconductor material. The hardness of it makes it difficult to polish using standard semiconductor techniques. A combination of physical mechanical polishing processes and non contact polishing processes is required to achieve a surface condition that is acceptable for a variety semiconductor and optical applications (eg: Tunable structures, Optically Pumped Semiconductor, Laser Inner Cavity, Laser Windows, Heat Sinks, Bonding, FETs, etc. . . ).

Traditional diamond polishers are utilized using impregnated or metal bonded diamond wheels for rough bulk polishing using a high precision level for parallelism. This achieves a flat and parallel surface that is within a few microns of device ready specifications. However, these surfaces typically have numerous multi-nanometer height spikes and discontinuities which prevent optical bonding, degrade photolithographic images and may literally be higher than the thickness of active layer in a tunable structure (ie: optical diamond waveguides, hetro-structures, delta doped structures, biosensor active layers, etc.).

Plasma, reactive ion etching (RIE) and Gas-cluster ion-beam (GCIB) are non contact processing techniques used to provide smooth, flat and parallel surfaces that can be directly applied to device applications. Plasma and RIE technique provide smooth and planarized surfaces which may leave undesirable surface damage. These techniques may be used separately or in combination with one another including GCIB to provide better surfaces and specifications that could not otherwise be attained. GCIB technology offers the ability to change the nature of the surface without affecting the bulk properties. A Gas Cluster Ion Beam (GCIB) source is able to deliver highly energetic clusters of weakly-bound atoms providing extremely low damaged surfaces. The gas-cluster beam is capable of providing smoothing etching and planarization of the extreme surface of numerous semiconductors, metals, insulators, and magnetic materials.

SUMMARY

A grown single crystal diamond may be polished using gas-cluster ion beam processing, which leaves a residue on the diamond surface. In one embodiment, a wet chemical etch is performed to remove the residue, leaving a highly polished single crystal diamond surface. In a further embodiment, a non-diamond abrasive is used in combination with rotating polishing pads to remove the residue. Such residue removing techniques normally do not affect a diamond surface, but in this case, operates well to remove the residue, leaving a highly polished smooth single crystal diamond surface. In one embodiment, the surface is also planar.

DETAILED DESCRIPTION

In the following description, reference is made to the accompanying drawings which are not to scale, that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

Single crystal diamond manufactured using chemical vapor deposition (DVD) (assisted by plasma, hot filament, flame, etc) in a reactor, is harder than any other semiconductor material. After the CVD single crystal diamond is removed from the reactor it may be cleaned using a wet chemical etch with sulfuric acid, hydrofluoric and/or nitric acid to remove residue left by the residual carbon from the growth process.

The CVD single crystal diamond may be preformed using a high accuracy laser cutting system providing a <20 um total surface variation. This minimizes the need for bulk diamond removal required to create a flat and parallel surface.

Traditional diamond polishers using cast iron diamond impregnated or metal bonded diamond wheels for rough bulk polishing may be used to further polish the CVD single crystal diamond with a high precision level to maintain and improve flatness and parallelism. The polishing wheel may be run at a range from 500–3000 rotations per minute with a grit size ranging from 50 nm–20 um. In one embodiment, a 20 um metal bonded wheel may be cycled at 2500 rpm to provide approximately 1 um/hour removal rates. Different desired removal rates may be obtained by varying the grit size and rpms. This process provides for surface characteristics as good as or better than the following:

a. Parallelism ~5 Arc/mins
b. Flatness ~0.25 /lambda (525 nm=lambda)
c. Roughness ~100 nm A sub micron grit polish may then be applied to the rough bulk polished CVD single crystal diamond. This can be achieved by utilizing a single side or double side polishing process with diamond slurry or diamond impregnated wheels. In one embodiment, a 50 nm diamond slurry using a mechanical polisher may be used with a wheel rotation of 30–500 rpm with high pressure. This process may provide sub micron polished CVD single crystal diamond having surface characteristics as good as or better than the following:

a. Parallelism ~30 Arc/secs.
b. Flatness ~0.25–0.10 /lambda (lambda=525 nm) using for example an optical interferometer.
c. Roughness ~50 nm using for example, atomic force microscopy.

Figure 1:
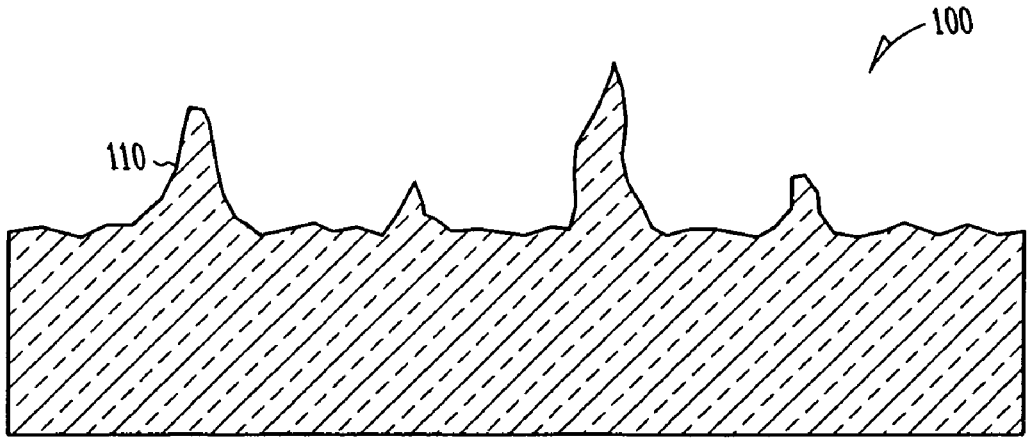
FIG. 1 is a cross section of a submicron polished diamond according to an example embodiment.

The sub micron polished CVD single crystal diamond substrate as illustrated at 100 in FIG. 1, is characterized to determine the flatness, smoothness, and parallelism of the substrate. These results are then used to determine the type of non contact processing required for the final diamond product form. In one embodiment, spikes 110 occur on the surface of the sub micron polished CVD single crystal diamond. The spikes have a height similar to the roughness described above. The formation of active layers is greatly impeded by such spikes, as the active layers may have dimensions much smaller than the roughness. Polishing in the above manner can also create dislocations and additional Nv centers, which can impede the formation of location controlled N-V centers desired for the creation of Qubits.

RIE, Plasma and GCIB are all non contact polishing processes that can be utilized to further smooth, plane or a shape CVD single crystal diamond. In one embodiment, the diamond may be rough polished to approximately ¼ wave prior to use of these non contact polishing processing methods. The method chosen may be dependent upon the specifications of the diamond product's form, such as whether the shape of the diamond surface is slightly convex or concave, or already relatively flat. In addition, it is dependent on the resulted sub surface damage created by the sub-micron polishing process. In one embodiment, the processing may be done to provide a ½5th to ⅟100th wave polish or better.

A sub micron polished diamond may be preformed, and further polished using such non-contact processes (Plasma, RIE and Gas-cluster ion beam processing) result in the following surfaces characteristics:

a. Parallelism <10 Arc/secs.

b. Flatness<0.02 /lambda (lambda=525 nm)

c. Roughness <5 nm

Figure 2:
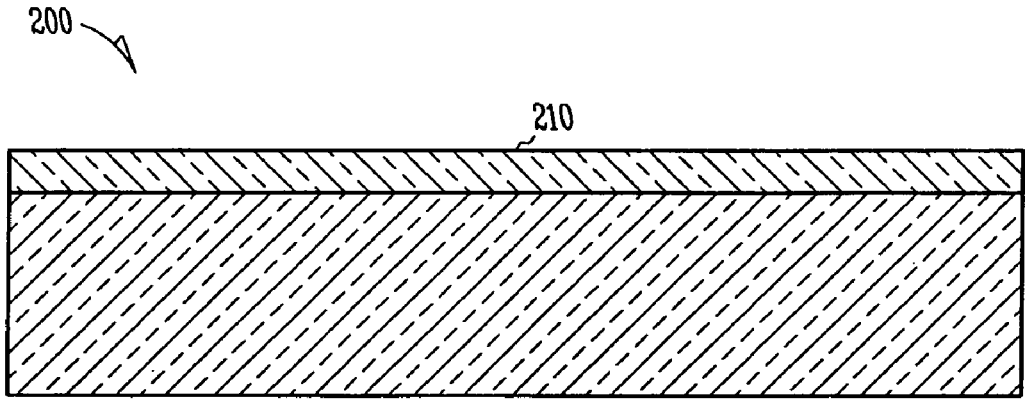
FIG. 2 is a cross section of a diamond polished with a non-contact polishing method according to an example embodiment.

RIE, Plasma, and/or gas cluster ion beam processing on diamond removes spikes, while providing a flat surface as shown at 200 in FIG. 2 suitable for semiconductor applications, leaves a hard carbonaceous residue 210, which has a spectrum similar to diamond like carbon. The layer has the appearance of a hard and impervious cruddy looking brown. This hard carbonaceous residue can vary in thickness from a few mono-layers to many microns. The thickness of the hard carbonaceous residue may be an indicator in which method or methods may be used in removal. In one embodiment, the gas is argon, and argon ions are directed at a low angle toward the surface of a diamond substrate.

Such non-contact polishing may also remove surface dislocations and N-V centers which may have formed during previous contact polishing techniques. Once removed, implantation of nitrogen may be performed to form N-V vacancies in a controller manner to form Qubits where desired.

While the non-contact processing, such as gas cluster ion beam processing provides an overall smooth surface polish, the residue makes it unsuitable for many purposes. In one embodiment, the diamond is a single crystal diamond formed using one of many different CVD processes.

In one embodiment, the residue is removed by the use of a wet chemical etch. A mixture of sulfuric and nitric and/or hydrofluoric acid is used in one embodiment to remove the residue and provide a highly polished diamond surface in combination with the non contact polishing processing. One example ratio is 3:1 sulfuric to nitric acid at 180° C. Other ratios and chemistries may also be used.

In a further embodiment, the residue is removed by use of a colloidal suspension in combination with a rotating polishing pad, where the suspension is softer than diamond, such as 50 nm colloidal silica in a ratio of 2:1 with water. Particles may also comprise alumina abrasive particles ranging approximately from 30 nm to 200 nm. Polishing pads are rotated with the suspension at between approximately 30 to 3500 revolutions per minute. In one embodiment, the polishing pad is rotated at approximately 500 rpm or higher. The pads in one embodiment are fairly hard, and may be made of materials such as stainless steel, plastic or fiberglass among others, including non-metallic pads. While such rotational polishing methods using silica or other soft materials are not known to effectively polish diamond, they work particularly well in removing the residue from the RIE, Plasma, and/or gas cluster ion beam processing. The result is a highly polished diamond surface.

In one embodiment, the diamond to be polished is single crystal diamond grown using chemical vapor deposition techniques. Many different sizes of such diamond may be polished, and the resulting finish may provide better than ⅟10 wave polishing up to and better than ⅟100 wave polishing. Such polished surfaces are suitable for optical bonding processes and use in optics. Further, the surface of the diamond is ready for formation of semiconductor devices or formation of nanoelectromechanical devices. Liftoff techniques, involving ion implantation at desired depths may be used to obtain multiple device ready wafers each essentially replicating the highly polished diamond surface.

In a further embodiment, a grown single crystal diamond is polished using RIE, Plasma, and/or gas-cluster ion beam processing. The diamond is first rough polished prior to using the RIE, Plasma, and/or gas-cluster ion beam processing. Residue is then removed by rotating polishing pads with a colloidal or a non diamond abrasive particle solution. The colloidal or non diamond abrasive solution particles comprise abrasive particles ranging approximately from 30 nm to 200 nm. The polishing pad is rotated at approximately 500 rpm or higher, or between approximately 30 to 3500 rpm. In one embodiment, the colloidal particle solution comprises a two to one ratio of silica particles to water. A further wet chemical etch may be used to remove any remaining residue.

In a further embodiment, a method of finishing a grown single crystal diamond that has been polished using gas-cluster ion beam processing comprises rotating polishing pads with a colloidal particle solution to remove residue left by the gas-cluster ion beam processing.

In yet a further embodiment, a method of finishing a grown single crystal diamond that has been polished using gas-cluster ion beam processing comprises using a wet chemical etch with sulfuric nitric acid and/or hydrofluoric acid to remove residue left by the gas-cluster ion beam processing. The ratio of sulfuric to nitric acid is approximately 3:1 at 180° C.

CVD single crystal diamond polished in this manner provides a surface of the diamond that is ready for formation of semiconductor devices or formation of nanoelectromechanical devices. Such devices may have active layers that are smaller than spikes in the surface of the polished diamond. Liftoff techniques, involving ion implantation at desired depths may be used to obtain multiple device ready wafers each essentially replicating the highly polished diamond surface. Such polished single crystal diamond may have an ultra smooth surface, and minimal surface defects. They may be used as seeds for low defect CVD diamond growth. In some embodiments, the surface has minimal discontinuities, with results in less scatter for applications in optics. The surface may be optically and physically smooth, provide excellent optical and contact bonding surfaces.

In a further embodiment, oxygen may be used as a source gas for GCIB processing to planarize diamond surfaces that are not flat. Further smoothing may be accomplished by using different ions, such as argon following the use of oxygen. Residue may be removed between different GCIB processing steps.

In still further embodiments, the polishing may be applied to polycrystalline and nanocrystalline diamonds. Also, the polishing processes may be applied to natural minded diamond, or diamond produced by other means, such as high pressure, high temperature industrial processes.

Figure 3:
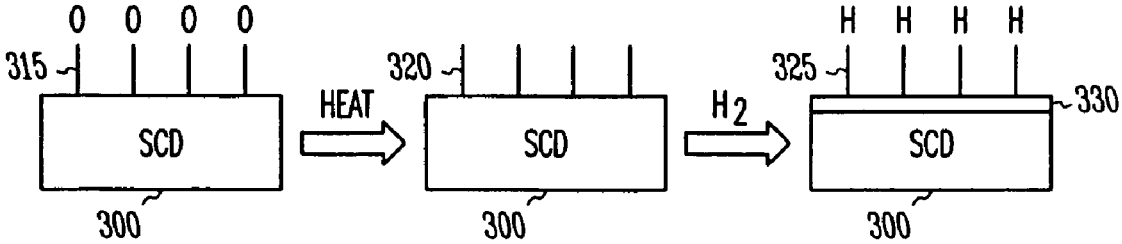
FIG. 3 is a block flow diagram illustrating formation of an active layer according to an example embodiment.

The polishing processes described provide very smooth diamond surfaces, including smooth single crystalline diamond surfaces. Many different devices may be formed in and on such surfaces. In one embodiment, active layers in a single crystal diamond 300 may be formed as illustrated in FIG. 3. On a surface of the diamond, after formation, such as by CVD, carbon bonds 310 may be terminated in oxygen, as illustrated at 315. In one embodiment, the diamond 300 may be heated in a vacuum at approximately 350° C. or other temperature sufficient to remove the oxygen and leave carbon dangling bonds as shown at 320. Hydrogen may be fixed on the dangling cabon as shown at 325 by use of a hydrogen plasma. The hydrogen terminated carbon bonds appear to create p type diamond just below the surface of the diamond as illustrated at 330. This may occur as the result of an electric field that extends just underneath the surface of the diamond.

Figure 4:
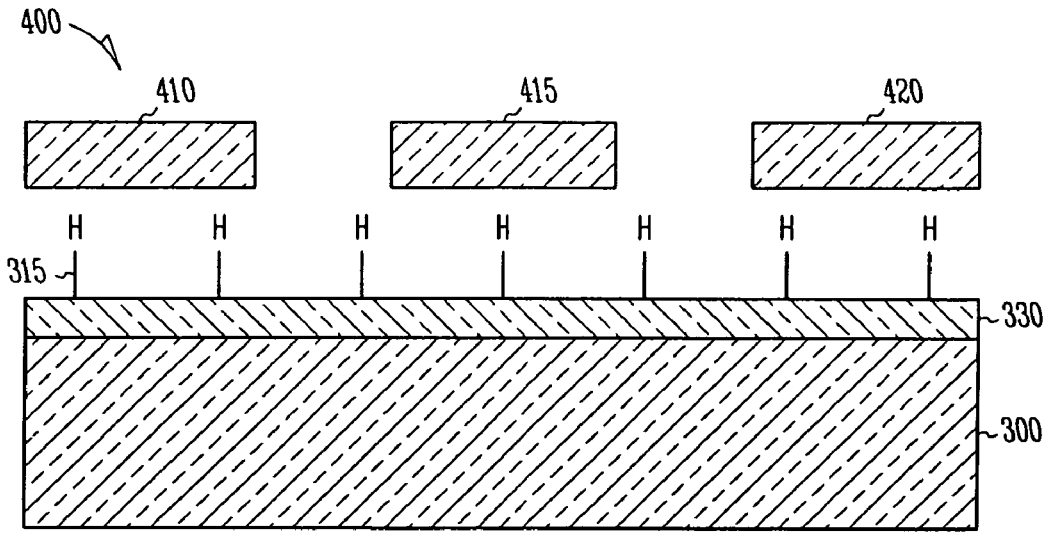
FIG. 4 is a cross section illustrating contacts formed on a single crystal diamond according to an example embodiment.

Conductive contacts may be formed on top the hydrogen terminated single crystal diamond as shown at 400 in FIG. 4 to form a field effect transistor (FET). The contacts may be formed of metal or other suitably conductive material and patterned to provide a source 410, gate 415 and drain 420. In further embodiments, the hydrogen terminated diamond surface may have selected areas of hydrogen replaced by bioreceptive or chemoreceptive molecules to form bio-FETs. The current through such a device may be a function of the presence of molecules in a solution that bond with the receptive molecules.

Figure 5:
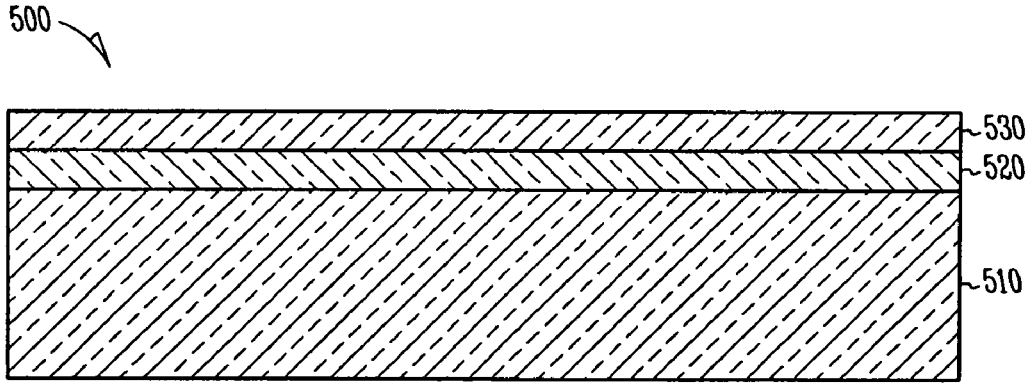
FIG. 5 is a cross section illustrating formation of a transistor in a single crystal diamond layer according to an example embodiment.

In a further embodiment, a transistor 500 is formed as illustrated in FIG. 5. In this embodiment, a single crystal diamond 510 is polished in accordance with the methods above to create a very smooth surface. A boron doped single crystalline diamond layer 520 is then formed as a very thin layer. In one embodiment, the layer is a approximately 5 nm, but may vary between 1 to about 10 nm in various embodiments. In further embodiments, thinner layers may be formed. These layers are approaching molecular levels. A further single crystal diamond layer 530 is formed on top of the boron doped layer 520. The thin boron doped layer is an n-type layer, and it creates thin p-type layers in the layers surrounding it, creating a pnp transistor. As the boron doped layer 520 becomes thinner, it creates a confining carrier layer, which increases the concentration of carriers. Some carriers diffuse into layers 530 and diamond 510.

Figure 6:
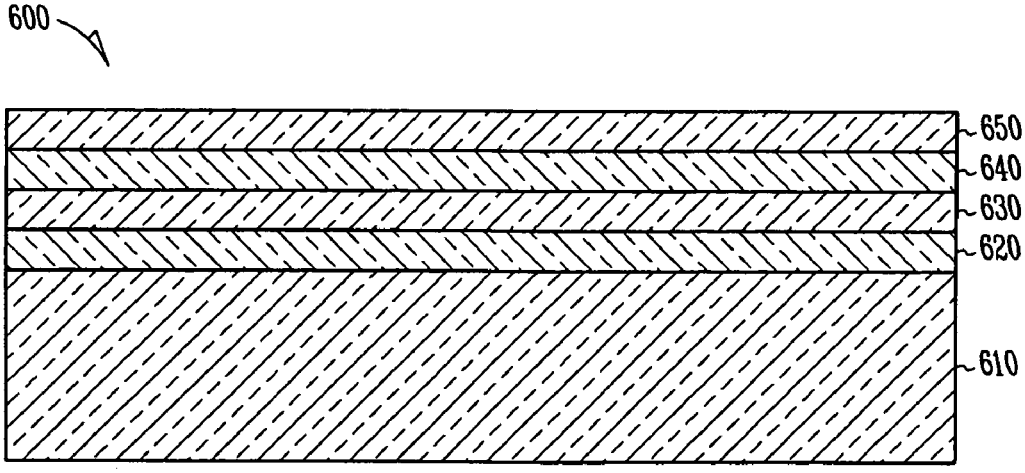
FIG. 6 is a cross section illustrating formation of multiple doped layers in a single crystal diamond according to an example embodiment.

In yet a further embodiment, as illustrated at 600 in FIG. 6, a single crystal diamond 610 is polished in accordance with the methods above to create a very smooth surface. A phosphorous doped layer 620 is formed, followed by an undoped layer 630. A boron doped single crystalline diamond layer 640 is then formed as a very thin layer. In one embodiment, the layer is a approximately 5 nm, but may vary between 1 to about 10 nm in various embodiments. In further embodiments, thinner layers may be formed. These layers are approaching molecular levels. A further single crystal diamond layer 650 is formed on top of the boron doped layer 640. The thin boron doped layer is an n-type layer, and it creates thin p-type layers in the layers surrounding it, creating a pnp transistor. As the boron doped layer 640 becomes thinner, it creates a confining carrier layer, which increases the concentration of carriers. Some carriers diffuse into layers 630 and 650.

While boron and phosphorous are described as dopants, other dopants may also be used, such as nitrogen or lithium to obtain n-type doping. Still further dopants may also be used to create desired type doping. In one embodiment, the gas cluster ion beam processing may be done with ions of different dopants at a low angle with suitable energies to implant desired dopants to desired shallow or ultra-shallow depths. Such doping may result in very shallow and abrupt doping profiles.

In one embodiment, a gas cluster ion beam source, such as $B_2H_6$ or $BF_3$ source gas, is used to produce energetic clusters of atoms. Unlike ion implantation, which involves a single ionized atom or gas molecule, cluster ions typically contain >5000 atoms per charge. These gas cluster ions are accelerated through potentials of a few thousand volts. Although the gas cluster ions have high total energy, the energy is shared by the large number of atoms comprising the cluster, so the energy per atom is <10 eV.

The cluster transfers its energy into a volume on the surface. The energy propagates in three dimensions and is quickly quenched. When the clusters contact the surface, solids incorporated in the cluster are infused into a heated/pressurized zone. The doping depth is related to the beam energy to the ⅓ power. Since the cluster energy is shared among the constituent atoms, each atom has only a few eV of energy, resulting in shallow doping of the substrate.

The Abstract is provided to comply with 37 C.F.R. §1.72(b) to allow the reader to quickly ascertain the nature and gist of the technical disclosure. The Abstract is submitted with the understanding that it will not be used to interpret or limit the scope or meaning of the claims.

What is claimed is:

1. A method of finishing a CVD grown single crystal diamond that has been planarized using non contact polishing technique, the method comprising:

rotating polishing pads with a colloidal soft particle solution to remove residue left by the non contact polishing technique.

2. The method of claim 1 wherein the colloidal soft solution particles comprise particles ranging approximately from 30 nm to 200 nm.

3. The method of claim 1 wherein the polishing pad is rotated at between approximately 30 to 3500 rpm.

4. The method of claim 1 wherein the colloidal particle solution comprises a two to one ratio of silica particles to water.

5. The method of claim 1 wherein the polishing pad is rotated at approximately between 300 to 1000 rpm.

6. The method of claim 1 wherein the polishing pad comprises a hard, non-metallic pad.

7. The method of claim 6 wherein the polishing pad comprises plastic or fiberglass.

8. The method of claim 1 wherein the residue comprises a hard carbonaceous residue.

9. The method of claim 1 and further comprising using ion implantation liftoff techniques to duplicate finished surfaces on lifted off layers of diamond.

10. A method of finishing a diamond that has been polished using a non contact polishing technique, the method comprising:

rough polishing the diamond prior to using the non contact polishing technique; and rotating polishing pads with a colloidal particle solution to remove residue left by the non contact polishing technique.

11. The method of claim 10 wherein the colloidal solution particles comprise silica or alumina particles ranging approximately from 30 nm to 200 nm.

12. The method of claim 10 wherein the polishing pad is rotated at approximately 500 rpm or higher.

13. The method of claim 10 wherein the colloidal particle solution comprises a two to one ratio of silica particles to water.

14. The method of claim 10 wherein the polishing pad is rotated at approximately between 300 to 1000 rpm.

15. The method of claim 10 wherein the polishing pad comprises a hard, non-metallic pad.

16. The method of claim 15 wherein the polishing pad comprises plastic or fiberglass.

17. The method of claim 10 wherein the residue comprises a hard carbonaceous residue.

18. The method of claim 10 and further comprising using a wet chemical etch with sulfuric nitric acid and hydrofluoric acid to remove residue left by the polishing pads.

19. The method of claim 10 and further comprising using ion implantation liftoff techniques to duplicate finished surfaces on lifted off layers of diamond.

20. A method of processing a CVD single crystal diamond, the method comprising:

preforming the CVD single crystal diamond to a desired shape;

using diamond grit to polish the CVD single crystal diamond to a sub micron polish;

using a non-contact polish technique to polish the CVD single crystal diamond to a roughness of approximately less than 5 nm; and removing residue remaining from the non-contact polish technique using at least one of wet chemical etch and soft particle colloidal suspension with a polishing pad.

21. The method of claim 20 wherein the wet chemical etch uses a mixture of sulfuric nitric and/or hydrofluoric acid.

22. The method of claim 20 wherein the soft particle colloidal suspension comprises colloidal silica in a ration of 2:1 with water.

23. The method of claim 22 wherein the colloidal silica comprises 50 nm silicon particles.

24. The method of claim 20 wherein the soft particle colloidal suspension comprises alumina abrasive particles.

25. The method of claim 24 wherein the alumina particles are approximately 30 nm to 200 nm.

26. The method of claim 20 wherein the polishing pad is rotated with the suspension at between approximately 30 to 3500 revolutions per minute.

27. The method of claim 20 wherein the resulting finish provides better than 1/10 wave polish.

28. The method of claim 20 wherein the resulting finish provides better than $1/100^{th}$ wave polish.

29. A method of processing a CVD single crystal diamond, the method comprising:

performing the CVD single crystal diamond to a desired shape;

using diamond grit to polish the CVD single crystal diamond to a sub micron polish;

using a non-contact polish technique to polish the CVD single crystal diamond to a roughness of approximately less than 5 nm;

removing residue remaining from the non-contact polish technique using a soft particle colloidal suspension with a polishing pad; and using a wet chemical etch to provide a finished CVD single crystal diamond.

30. The method of claim 29 wherein the wet chemical etch comprises a ratio of sulfuric to nitric acid of approximately 3:1 at 180° C.

31. The method of claim 29 wherein the resulting finish provides better than 1/10 wave polish.

32. The method of claim 29 wherein the resulting finish provides better than $1/100^{th}$ wave polish.

* * * * *